US007036676B2

(12) United States Patent
Christensen

(10) Patent No.: US 7,036,676 B2
(45) Date of Patent: May 2, 2006

(54) FOLDABLE WATER TANK

(75) Inventor: Jan Christensen, Rock Island, IL (US)

(73) Assignee: Eldred Corporation, Milan, IL (US)

( * ) Notice: Subject to any disclaimer, the term of this patent is extended or adjusted under 35 U.S.C. 154(b) by 0 days.

(21) Appl. No.: 10/677,740

(22) Filed: Oct. 3, 2003

(65) Prior Publication Data

US 2005/0072779 A1 Apr. 7, 2005

(51) Int. Cl.
*B65D 90/02* (2006.01)

(52) U.S. Cl. ..... 220/565; 220/9.4; 220/666; 220/904

(58) Field of Classification Search ..... 220/9.1, 220/9.2, 9.3, 9.4, 495.01, 495.06, 495.08, 220/495.1, 651, 661, 666, 668, 904, 565; 52/646; 4/488, 587; 248/97, 99, 146, 150, 248/282.1; 383/33, 104, 119
See application file for complete search history.

(56) References Cited

U.S. PATENT DOCUMENTS

| | | | | |
|---|---|---|---|---|
| 1,307,942 | A | 6/1919 | Volters | |
| 1,533,636 | A | 4/1925 | Day | |
| 1,738,017 | A | 12/1929 | Phillips | |
| 2,567,514 | A | 9/1951 | Hoffman | |
| 2,593,408 | A * | 4/1952 | Boardman | 220/565 |
| 2,638,951 | A * | 5/1953 | Smith et al. | 220/666 |
| 2,749,956 | A | 6/1956 | Eldred | |
| 2,854,049 | A * | 9/1958 | Wyllie | 220/565 |
| 2,950,484 | A * | 8/1960 | Jaffe | 4/587 |
| 3,603,541 | A | 9/1971 | Sturm | |
| 4,281,813 | A | 8/1981 | Garrity | |
| 4,356,933 | A | 11/1982 | Connolly | |
| 4,383,564 | A * | 5/1983 | Hoie | 383/66 |
| 4,993,635 | A * | 2/1991 | Dupre | 239/14.2 |
| 5,009,189 | A * | 4/1991 | Neff | 119/200 |
| 5,107,857 | A | 4/1992 | Linnemann et al. | |
| 5,316,175 | A * | 5/1994 | Van Romer | 220/573 |
| 5,429,437 | A * | 7/1995 | Shaw et al. | 383/33 |
| 5,622,344 | A * | 4/1997 | Gracie | 248/171 |
| 5,924,461 | A * | 7/1999 | Shaw et al. | 141/86 |
| 2003/0024203 | A1 * | 2/2003 | Kuo | 52/646 |

OTHER PUBLICATIONS

Fol-Da-Tank Gives Your Tanker Twice As Much Firefighting Ability, Spring 2003 Catalog.
STARTANK, Storage Tank for Permanent or Temporary Containment Of Many Types of Liquids, www.vikoma.com.
FASTANK, Emergency Water Storage.
FASTANK 2000 Parts List.
FASTANK, The Solution to Pollution, FAST Engineering Ltd., Northern Ireland.
SNAPTANK, Good Things come in small packages, Western Shelter Systems, Eugene, Oregon.

* cited by examiner

*Primary Examiner*—Stephen Castellano
*Assistant Examiner*—Harry Grosso
(74) *Attorney, Agent, or Firm*—Shlesinger, Arkwright & Garvey LLP

(57) ABSTRACT

A foldable water tank comprises a foldable receptacle having a bottom wall and vertical sidewalls, the sidewalls being inclined inwardly; and a plurality of support structures connected to the sidewalls to support the sidewalls in the inclined position.

18 Claims, 9 Drawing Sheets

FIG.4
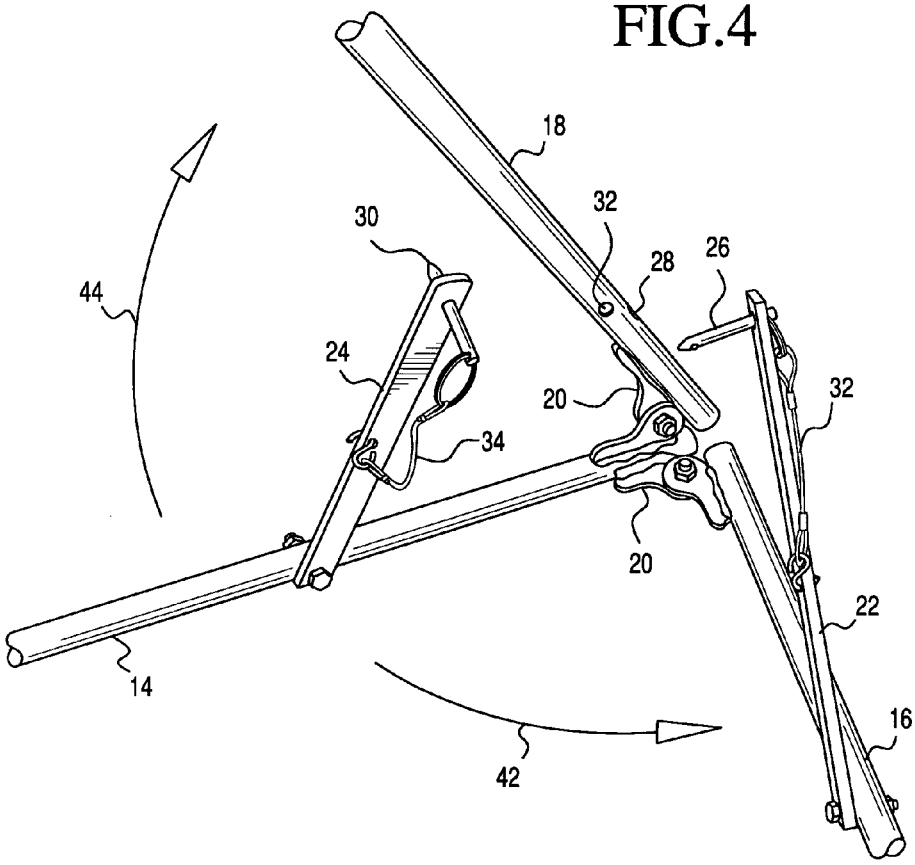
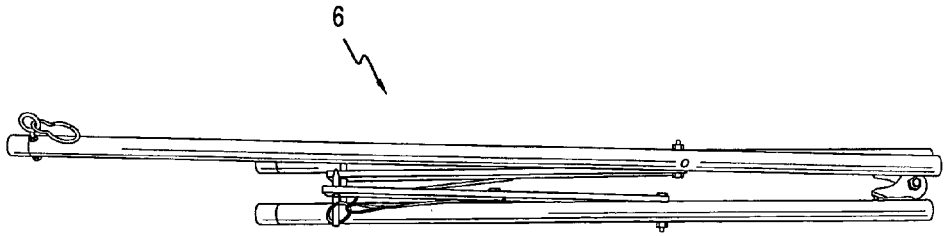
FIG.5

FIG.9
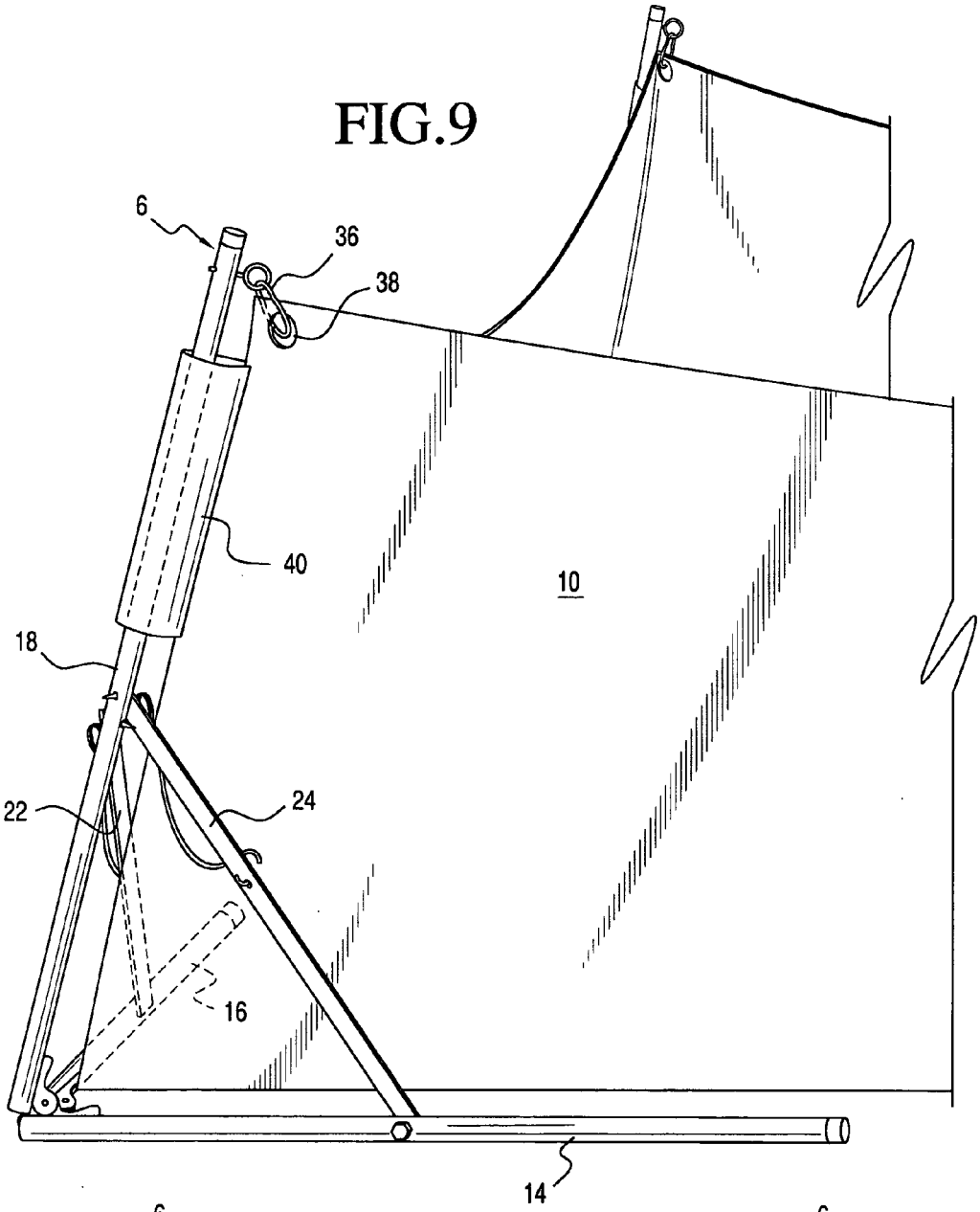
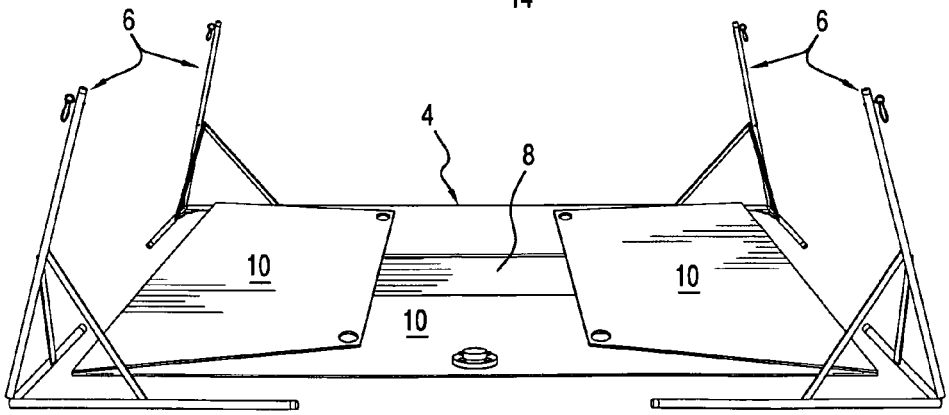
FIG.10

FIG.13
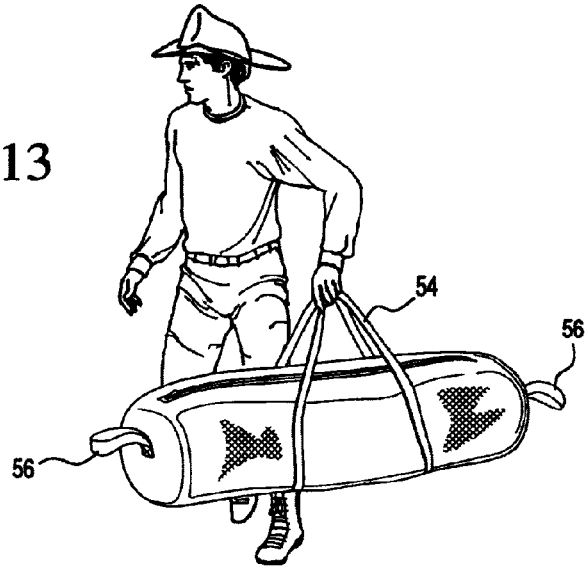
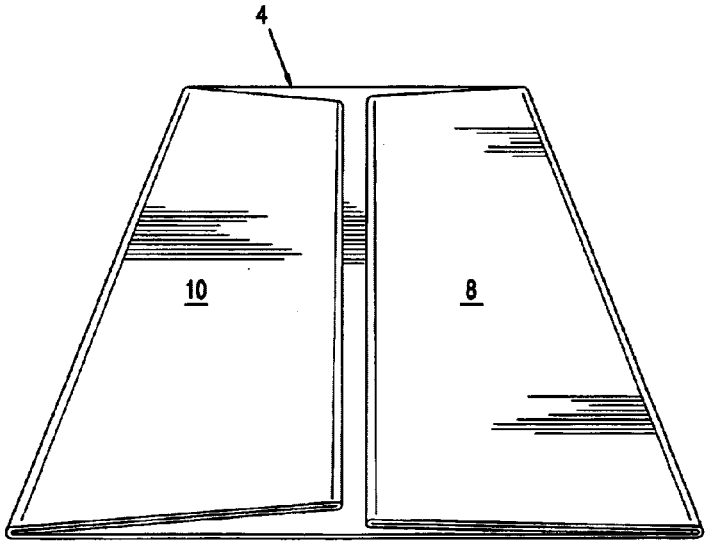
FIG.14

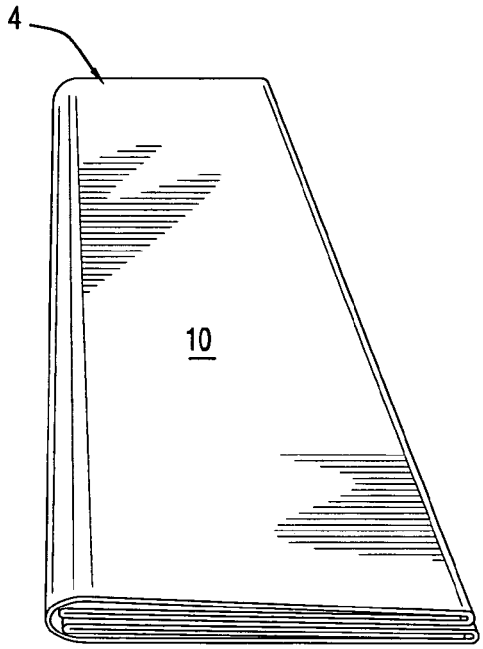
FIG.15
FIG.16
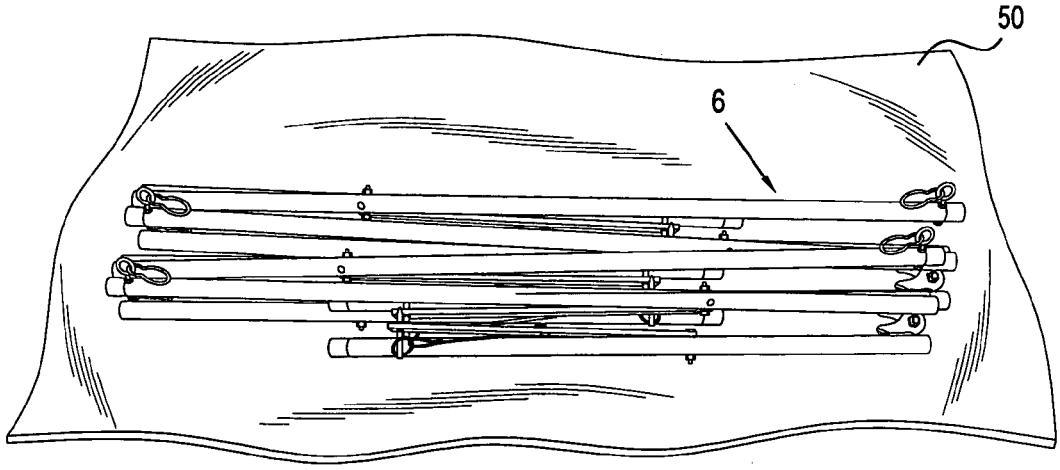

FOLDABLE WATER TANK

FIELD OF THE INVENTION

The present invention relates generally to a water tank, and specifically to a lightweight foldable water tank that can be stowed into a compact shape to facilitate transport to the scene of a fire.

BACKGROUND OF THE INVENTION

There is a need for larger portable water tanks to keep rural fire protection insurance down. However, the stowed tank sizes must be kept small to be accommodated on the top or sides of fire trucks. When the tanks reach 14–20 ft. long, storage can become a problem.

Portability is essential to forest fighters in remote areas. There is a need for lightweight portable tanks that can be shipped by helicopters in quantities and quickly assembled on site by one person.

OBJECTS AND SUMMARY OF THE INVENTION

It is an object of the present invention to provide a foldable water tank that can be stored in a relatively compact size to facilitate transport to the scene of a fire.

It is another object of the present invention to provide a foldable water tank that is relatively quick to assemble at the site of a fire.

It is still another object of the present invention to provide a foldable water tank that can be shipped to remote areas by helicopters and quickly assembled on site.

It is still another object of the present invention to provide a foldable water tank for use in rural and forestry areas where water supply is limited.

It is another object of the present invention to provide a foldable water tank that is compact in size so that it can be carried on a fire tanker truck when not in use and then deployed at the scene of a fire in a rural area for water storage.

In summary, the present invention provides a foldable water tank, comprising a foldable receptacle having a bottom wall and vertical sidewalls, the sidewalls being inclined inwardly; and a plurality of support structures connected to the sidewalls to support the sidewalls in the inclined position.

These and other objects of the present invention will become apparent from the following detailed description.

BRIEF DESCRIPTIONS OF THE DRAWINGS

FIG. 4 is fragmentary perspective view of a corner portion of the support structure of FIG. 3.

FIG. 5 shows the support structure of FIG. 3 in a stowed, folded position.

FIG. 9 is an enlarged detail view of a corner portion of the tank of FIG. 8.

FIGS. 10 and 11 show the water tank of FIG. 1 being unfolded and deployed.

FIG. 13 shows one person carrying the bag of FIG. 12 with the folded water tank stowed configuration inside.

FIGS. 14 and 15 shows the folding of the receptacle of FIG. 1 into thirds for stowage.

FIG. 16 shows the placement of the support structures of FIG. 5 over a tarp for stowage.

DETAILED DESCRIPTION OF THE INVENTION

Figure 1:
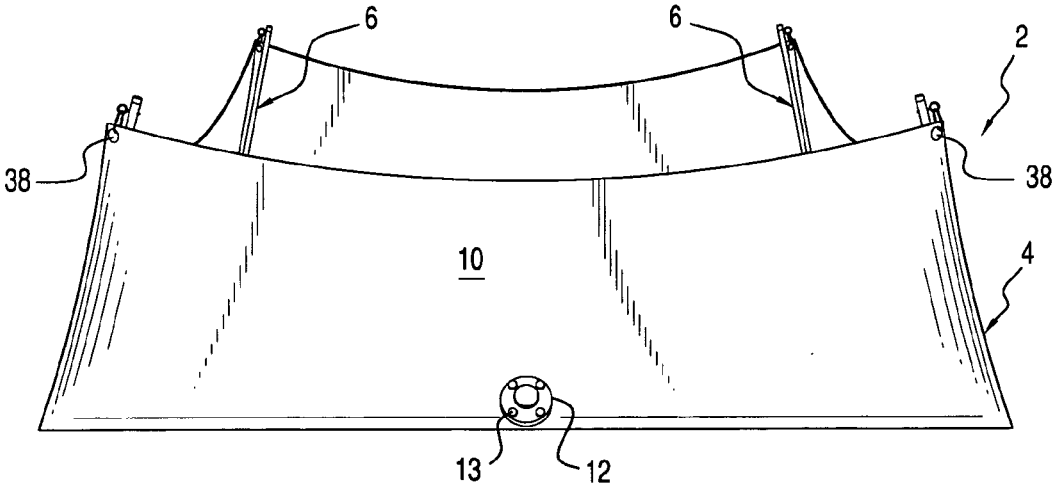
FIG. 1 is a perspective view of a foldable water tank made in accordance with the present invention.
Figure 2:
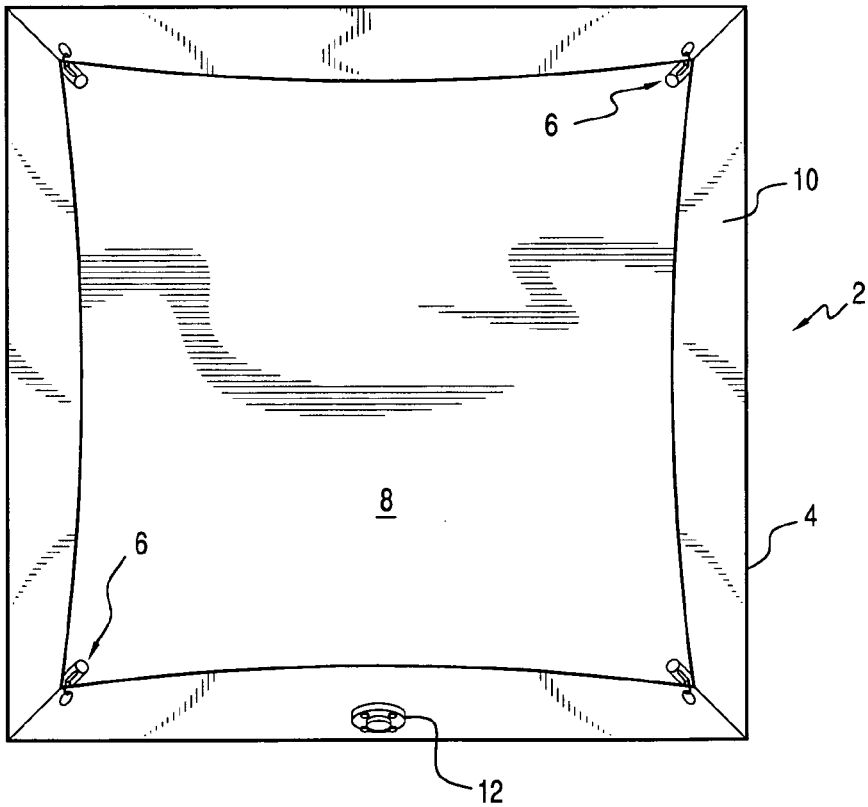
FIG. 2 is top plan view of FIG. 1.

A foldable water tank 2 made in accordance with the present invention is disclosed in FIGS. 1 and 2 in a deployed position. The water tank 2 includes a flexible receptacle 4 and a plurality of support structures 6 disposed within the receptacle 4. The receptacle 4 includes a bottom wall 8 and inwardly inclined side walls 10, forming a truncated pyramid with four upper corners. The receptacle 4 is made from conventional water tight material. The receptacle 4 has a standard fire department threaded flange 12 for connection to a filling or pumper truck (not shown) for filling or dispensing. The receptacle 4 may also be drained through the flange 12. The flange 12 is closed with a removable threaded cap 13 if not connected when not in use. The receptacle 4 has an open top to advantageously facilitate filling, for example, from above by a bucket-carrying helicopter. Although the truncated pyramid is shown as having a square base wall, it should be understood that it can be other shapes with the corresponding inclined sidewalls. The support structures 6 are preferably disposed inside the receptacle 4, but may also be disposed outside.

Figure 3:
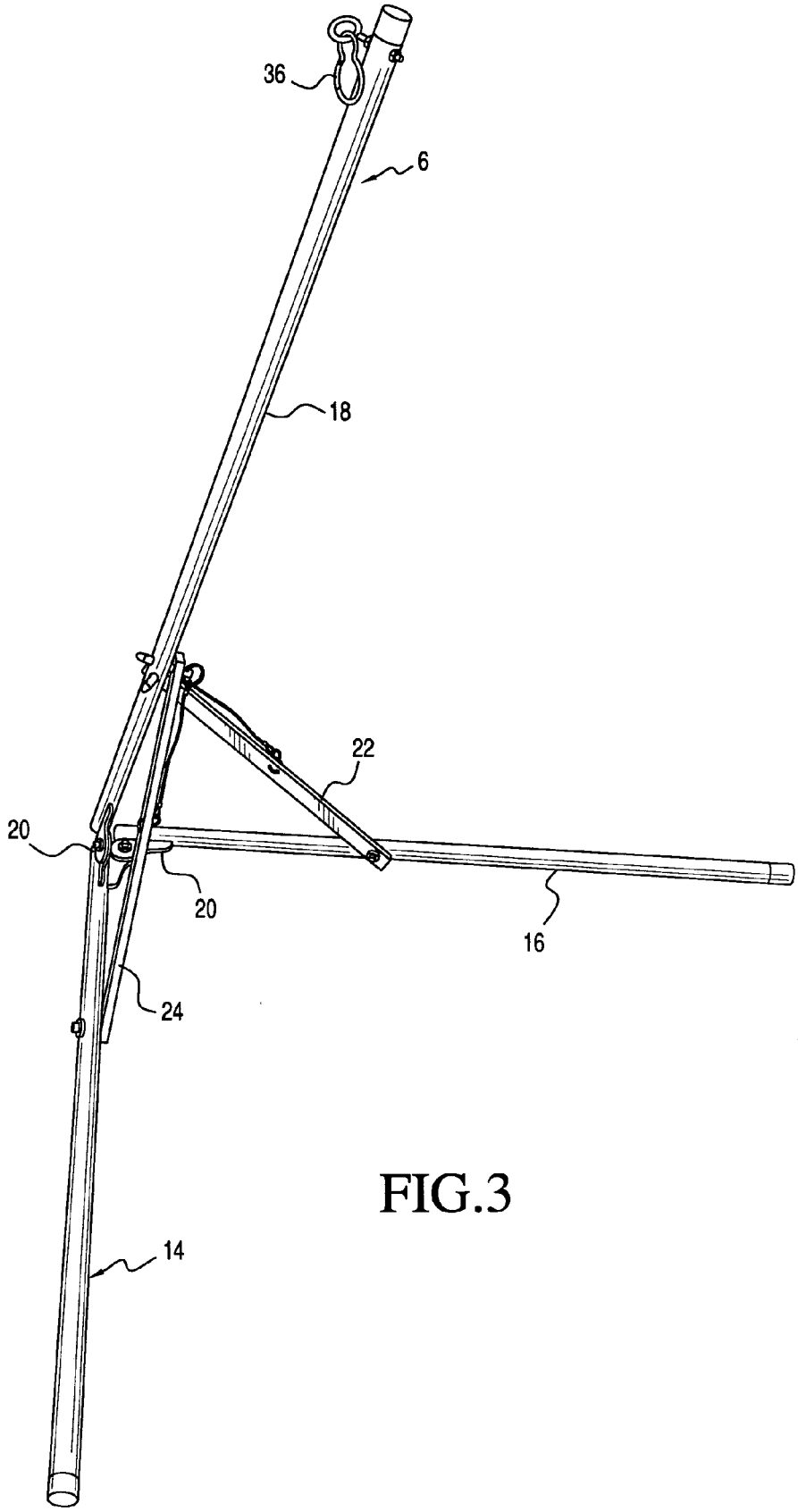
FIG. 3 is a perspective view of a support structure made in accordance with the present invention and shown in a deployed position.

Referring to FIGS. 3 and 4, each support structure 6 includes base members 14 and 16 and vertical member 18 joined at their one ends with pivots 20 so that the support structure may be collapsed into a compact configuration, as best shown in FIG. 5. It should be understood that the pivots 20 provide the means for collapsing the support structures 6 into a compact configuration. The pivots 20 may be of the ratcheting type of standard construction that selectively locks as the members 14, 16 and 18 are expanded so that the structure holds its deployed position. A brace 22 pivotably connected to the base members 16 and removably secured to the vertical member 18 may be used to provide further rigidity to the structure in the deployed position. Similarly, a brace 24 pivotably connected to the base member 14 and removably secured to the vertical member 18 may also be provided. A pin 26 is used to removably secure the brace 22 to the vertical member 18 through a hole 28 in the vertical member 18. Similarly, a pin 30 is removably secured in a hole 28 in the vertical member 18. Straps 32 and 34, one end of each is respectively secured to the brace members 22 and 24 are respectively secured to the pins 26 and 30 to prevent loss of the pins when the support structure 6 is folded and stowed away. The members 14, 16 and 18 are preferably lightweight tubular aluminum, but other materials and shapes may be used. The upper end of each vertical member 18 includes a clip 36 for hooking into a corresponding reinforced opening 38 in the receptacle 4 located at each upper corner of the truncated pyramid.

Since each support structure 6 is not connected to any of the other support structures, there is less hardware required, thereby making the support structures in the aggregate relatively lightweight.

Since a support structure 6 is not connected to any of the other support structure, there are less hardware required, thereby making the support structures in the aggregate relatively lightweight.

The vertical member 18 is inclined inwardly towards the base members 14 and 16, such that an acute angle is formed between the vertical member 18 and each of the base members 14 and 16. The inclination of the vertical member 18 is substantially, but not necessarily, the same as the inclination of the side walls 10 of the receptacle 4. The inclination of the vertical member 18 advantageously provides a stable support so that the support structure 6 remains upright during use to support the side walls 10 in the upright position. It should be understood that the inclined vertical member 18 and the supporting base members 14 and 16 provide the means to support the sidewalls in the inclined position.

Figure 6:
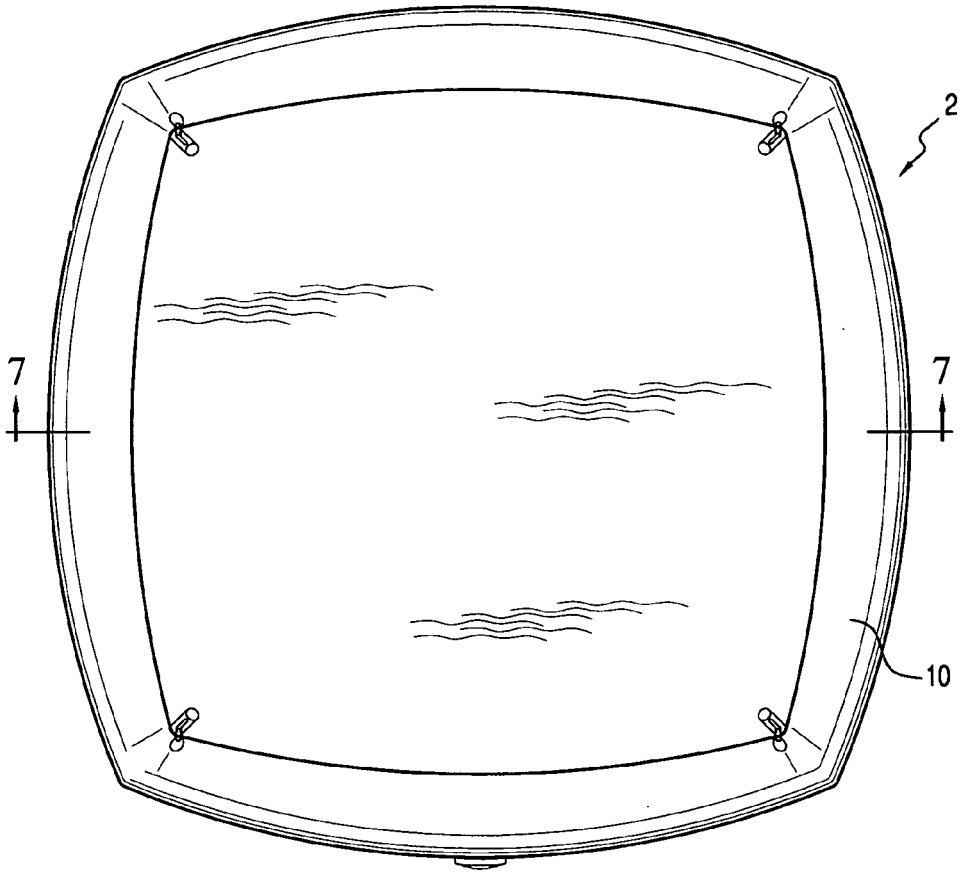
FIG. 6 is a top plan view of FIG. 1 when the tank is filled with water.
Figure 7:
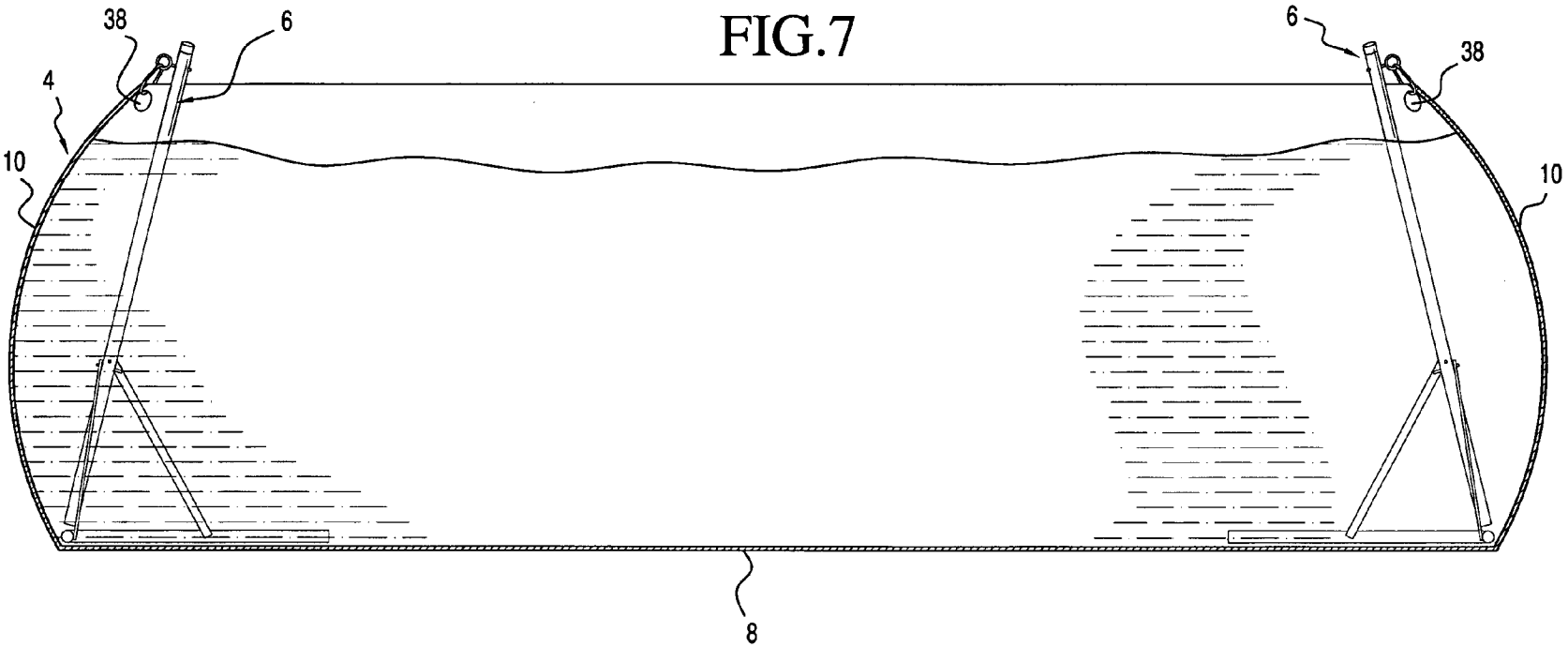
FIG. 7 is a cross-sectional view taken along line 7-7 of FIG. 6.

When the receptacle 4 is filled with water, the side walls 10 bulge out, as best shown in FIGS. 6 and 7. The water exerts pressure on the side walls and the resulting forces are transferred to the support structures 6 to keep the side walls in the upright position.

Figure 8:
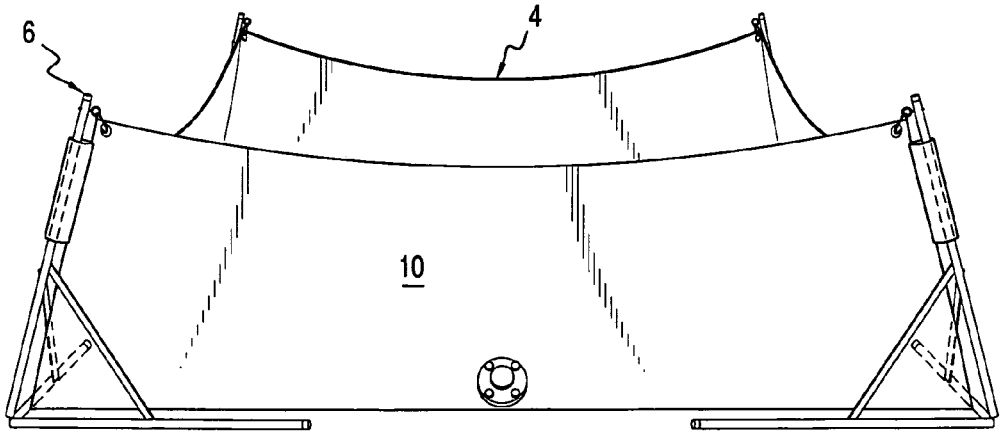
FIG. 8 is a perspective view of a foldable water tank, showing the deployed support structures disposed outside the receptacle.

Referring to FIGS. 8 and 9, the support structures 6 are disclosed as being disposed outside the receptacle 4. In this embodiment, the receptacle 4 is preferably provided with a sleeve 40 along each intersection the sidewall 10 with the adjacent sidewall. The sleeve 4 advantageously provides greater stability to the support structures 6 when in use.

Figure 11:
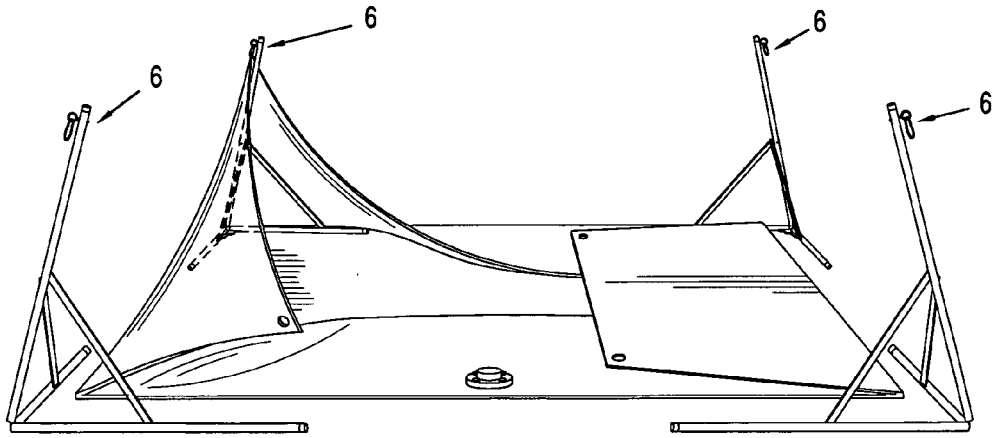

Referring to FIGS. 10 and 11, the water tank 2 is assembled by laying out the receptacle 4 on a relatively flat surface and placing the support structures 6 in the vicinity of each corner of the receptacle 4. Each support structures 6 is quickly deployed into its expanded position by spreading the base members 14 and 16 apart about its pivot 20, as generally shown by the arrow 42, rotating the vertical member 18 in the direction of the arrow 44 and securing the braces 22 and 24 to the vertical member 18, as best shown in FIG. 4. The deployed support structure 6 is then placed inside the receptacle 4 and the respective corner of the receptacle 4 is then lifted and secured to the clip 36 at the upper end of each vertical member 18.

A bag 46 is preferably provided to store the receptacle 4 and the support structures 6 in a compact, portable manner. The receptacle 4 is first folded and then rolled. After folding sidewalls 10 onto the base wall 8, as shown in FIG. 10, the receptacle 4 is then further folded into on another, such as into thirds, as shown in FIGS. 14 and 15. The receptacle 4 is then rolled into a compact configuration and secured with a strap 48 as shown in FIG. 12.

Figure 12:
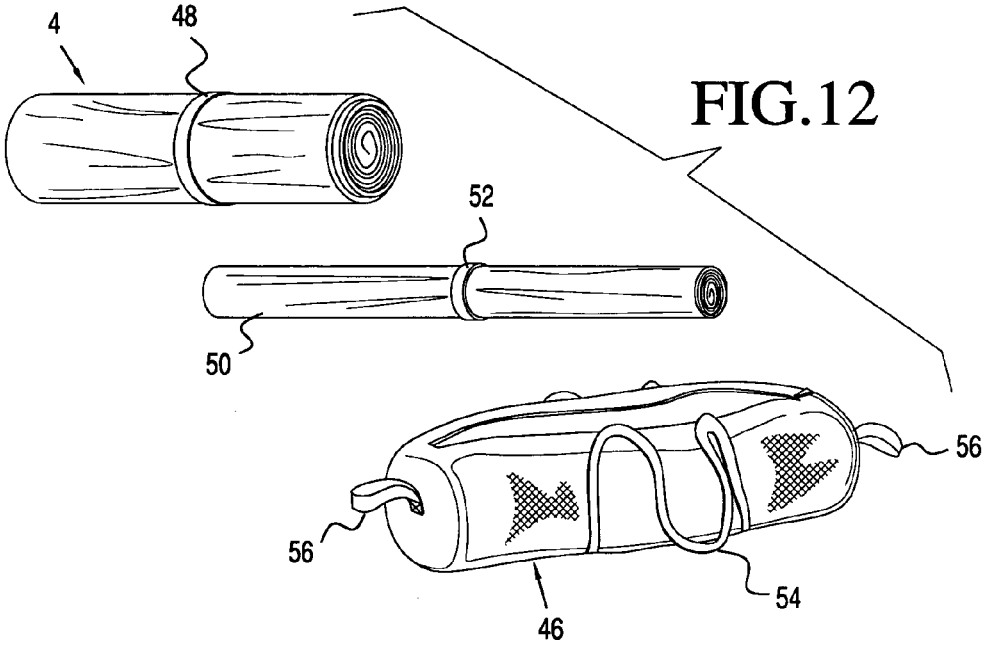
FIG. 12 shows the water tank of FIG. 1 in a stowed configuration for placement inside a carrying bag.

The support structures 6 are placed on a sheet material, such as a tarp 50, as shown in FIG. 16, and then rolled into a compact shape as shown in FIG. 12 held by a strap 52. The receptacle 4 and the support structures 6 in the configuration shown in FIG. 12 are then placed inside the bag 46 for storage or transport. The bag 46 has handle straps 54 for convenient handling by a single person. Additional straps 56 at each end of the bag are also provided for convenient handling by two people.

The foldable water tank 2 can be made with a capacity range of 500–2000 gallons while still maintaining its portability and compactness. The water tank 2 can be assembled by one person relatively quickly.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A foldable water tank, comprising:

a) a foldable receptacle having a bottom wall and vertical sidewalls, said sidewalls being inclined inwardly;

b) a plurality of support structures connected to said sidewalls to support said sidewalls in an inclined position when said receptacle is empty;

c) each of said support structures including first, second and third members pivotally joined at their first ends;

d) said members having a storage position wherein said members are adjacent each other and a deployed position wherein said members are spread apart from each other to form acute angles between each other at said first ends; and e) a first brace removably connected to said first and second members, and a second brace removably connected to said first and third members thereby to make said first member vertically and rigidly secured when deployed.

2. A foldable water tank as in claim 1, wherein said support structures are disposed within said receptacle.

3. A foldable water tank as in claim 1, wherein said support structures are disposed outside said receptacle.

4. A foldable water tank as in claim 1, wherein:

a) said receptacle is substantially a truncated pyramid having a plurality of upper corners; and b) each of said support structures is connected to a respective said upper corner.

5. A foldable receptacle as in claim 1, wherein:

a) said first member is inclined inwardly toward the interior of said receptacle; and b) a clip disposed at an upper end of said first member to hook into an opening in said sidewall.

6. A foldable receptacle as in claim 1, wherein said members are tubular.

7. A foldable water tank as in claim 1, wherein:

a) said first member is inclined vertically when deployed.

8. A foldable water tank as in claim 6, wherein:

a) said first and second braces are pivotally connected to said second and third tubular members, respectively; and b) said first and second braces are removably secured to said first tubular member.

9. A foldable water tank as in claim 1, wherein said receptacle has an open top.

10. A foldable water tank as in claim 1, wherein said receptacle includes an outlet or inlet flange.

11. A foldable water tank as in claim 1, and further comprising:

a) a bag configured to be carried by a person; and b) said receptacle when folded and said support structures in said storage position are configured to fit inside said bag.

12. A foldable water tank as in claim 5, wherein:

a) said receptacle includes a plurality of sleeves; and b) said first member of each support structure is received within a respective sleeve.

13. A foldable water tank, comprising:

a) a foldable receptacle having a bottom wall and vertical sidewalls, said sidewalls being inclined inwardly;

b) a plurality of support structures removably connected to said sidewalls to support said sidewalls in an inclined position when said receptacle is empty;

c) each of said support structures including a vertical member secured to a base, said vertical member being inclined in the direction of the respective sidewall; and d) said vertical member having a rigid and non-rotatable configuration when secured to the respective sidewall.

14. A foldable water tank as in claim 13, wherein said support structures include tubular members.

15. A foldable water tank as in claim 13, and further comprising means for folding said support structures into a compact configuration.

16. A foldable water tank as in claim 13, wherein said support structures are disposed within said receptacle.

17. A foldable water tank as in claim 13, wherein said support structures are disposed outside said receptacle.

18. A foldable water tank, comprising:

a) a receptacle having a bottom wall an open top and vertical sidewalls, said sidewalls being inclined inwardly;

b) said receptacle having a folded and rolled configuration when not in use;

c) a plurality of support structures to support said vertical sidewalls when said receptacle is empty; and d) said support structures having a rigid and non-rotatable configuration when deployed to support said vertical sidewalls during use and a collapsible configuration for storage.

* * * * *